US005388536A

United States Patent [19]

Chung

[11] Patent Number: 5,388,536

[45] Date of Patent: Feb. 14, 1995

[54] LOW $NO_x$ BURNER

[76] Inventor: Landy Chung, 5144 Cliff Dr., Ashtabula, Ohio 44004

[21] Appl. No.: 218,465

[22] Filed: Mar. 28, 1994

Related U.S. Application Data

[63] Continuation of Ser. No. 99,104, Jul. 29, 1993, abandoned, which is a continuation-in-part of Ser. No. 995,942, Dec. 21, 1992, Pat. No. 5,249,535, which is a continuation of Ser. No. 856,234, Mar. 25, 1992, abandoned.

[51] Int. Cl.[6] ..... F23D 1/02

[52] U.S. Cl. ..... 110/264; 110/347; 239/502; 431/183

[58] Field of Search ..... 110/347, 264, 263; 431/182, 183, 184; 239/500, 501, 502

[56] References Cited

U.S. PATENT DOCUMENTS

| | | |
|---|---|---|
| 1,527,214 | 2/1925 | Peabody . |
| 1,628,424 | 5/1927 | Peabody . |
| 1,870,013 | 8/1932 | Keenan, Jr. . |
| 1,995,934 | 3/1935 | Mangold . |
| 2,320,576 | 6/1943 | Dunn . |
| 2,480,547 | 8/1949 | Caracristi . |
| 2,525,432 | 10/1950 | Stadler . |
| 2,815,069 | 12/1957 | Garraway . |
| 2,838,103 | 6/1958 | Voorheis . |
| 2,889,871 | 6/1959 | Voorheis . |
| 3,145,670 | 8/1964 | Copian et al. . |
| 3,411,716 | 11/1968 | Stephan et al. . |
| 3,743,471 | 7/1973 | Jaeger . |
| 3,944,142 | 3/1976 | Welden et al. . |
| 4,050,632 | 9/1977 | Wyse . |
| 4,087,050 | 5/1978 | Tsuji et al. . |
| 4,089,637 | 5/1978 | Smith et al. . |
| 4,223,615 | 9/1980 | Breen et al. . |
| 4,253,403 | 5/1981 | Vatsky . |
| 4,348,170 | 9/1982 | Vatsky et al. . |
| 4,400,151 | 8/1983 | Vatsky . |
| 4,457,241 | 7/1984 | Itse et al. . |
| 4,504,216 | 3/1985 | Hagar et al. . |
| 4,681,532 | 7/1987 | Chung . |
| 4,927,352 | 5/1990 | Chung . |
| 5,113,771 | 5/1992 | Rini et al. . |

FOREIGN PATENT DOCUMENTS

| | | |
|---|---|---|
| 233901 | 1/1960 | Australia . |
| 339844 | 8/1921 | Germany . |
| 958907 | 5/1964 | United Kingdom . |

OTHER PUBLICATIONS

"Current Developments in Low $NO_x$ Firing Systems", published by Combination Engineering, Inc., Oct. 1980.

"Large Burners and Low $NO_x$", Foster Wheeler Energy Corporation brochure, published 1979.

EPRI Journal, Published Nov. 1984 by Electric Power Research Institute, Inc., pp. 26–33.

"C-E Wide-Range Coal Nozzle" Info. Bulletin, pub. by Combustion Engineering, bearing a copyright notice of 1985.

"Experience in Reducing $NO_x$ Emissions on Operating Steam Generators". Published by Foster Wheeler and bearing dates Nov. 8 and 9, 1978.

*Primary Examiner*—Edward G. Favors

*Attorney, Agent, or Firm*—Watts, Hoffmann, Fisher & Heinke

[57] ABSTRACT

A low-nox burner for use in industrial furnaces and/or boilers which burn pulverized coal. The burner includes a burner tip which divides an annular pulverized coal stream into alternating fuel-rich and fuel-lean streams. The tip includes a plurality of alternating main and secondary blade members which are skewed to produce rotational movement in the streams. The main blade has a leading edge that is aligned with a radial vector extending through a center axis of the burner and a trailing edge that is tilted with respect to the radial vector in order to define a substantially planar surface between the leading and trailing edges. The secondary blade includes leading and trailing edges that are both aligned with radial vectors and defines a twisted surfaces between the edges. The secondary blade is skewed with respect to the longitudinal direction by an angle that is substantially greater than the angle at which the main blade is skewed. As a result, channels having converging cross sections are defined between the main blade and one adjacent secondary blade, and diverging channels are defined by the main blade and another adjacent secondary blade. During operation, the tip creates a fuel-rich zone surrounded by a fuel-lean zone in the combustion region.

28 Claims, 6 Drawing Sheets

LOW $NO_x$ BURNER

TECHNICAL FIELD

This application is a continuation of application Ser. No. 08/099,104, filed Jul. 29, 1993, now abandoned, which is a continuation-in-part patent application of U.S. Ser. No. 07/995,942, filed Dec. 21, 1992, U.S. Pat. No. 5,249,535, which is a continuation of U.S. Ser. No. 07/856,234, filed Mar. 25, 1992, now abandoned. The present invention relates generally to industrial furnaces and/or boilers which burn pulverized coal, and more specifically, to an improved coal burner which reduces the formation of nitrogen oxides during the combustion process.

BACKGROUND

Recently, considerable attention and efforts have been directed to the reduction of nitrogen oxides resulting from the combustion of fuel. This is especially true in the area of large furnaces or boilers such as used by the power generation utilities which utilize coal as their main fuel source. In a typical arrangement for burning coal in a large boiler, several burners are disposed in communication with the interior of the boiler and operate to burn a mixture of air and pulverized coal. The burners used in these arrangements are generally of the type in which a fuel-air mixture is continuously injected through a nozzle so as to form a single, relatively large flame. As a result, the surface area of the flame is relatively small in comparison to its volume, and therefore, the average flame temperature is relatively high. However, in the burning of coal, nitrogen oxides are formed due to the reaction of nitrogen present in the combustion-supporting air with oxygen. The formation of nitrous oxides is a function of flame temperature. When the flame temperature exceeds 2800° F., the amount of nitrogen removed from the combustion-supporting air rises exponentially with increases in the temperature. This condition leads to the production of high levels of nitrogen oxides in the final combustion products, which is undesirable.

Nitrogen oxides are also formed from the fuel bound nitrogen available in the fuel itself, which is not a direct function of the flame temperature, but is related to the quantity of available oxygen during the combustion process.

DISCLOSURE OF THE INVENTION

It is, therefore, an object of the present invention to provide a burner assembly which operates in a manner to considerably reduce the production of nitrogen oxides in the combustion of fuel.

It is a more specific object of the present invention to provide an improved burner for use in a furnace which burns a pulverized coal-air mixture and which has an adjustable inner burner tip which provides proper fuel flow velocity at the burner outlet.

It is a still further object of the present invention to provide an improved burner nozzle of the above type in which the adjustable nozzle tip is designed to deliver the fuel in multiple streams and various patterns, more specifically, fuel-lean and fuel-rich zones to create stage-type combustion.

The present invention provides a new and improved coal burner which reduces formation of nitrogen oxides (hereinafter NOx) in a combustion zone of a large industrial boiler/furnace such as used by the utility industry.

The disclosed burner can be retro-fitted to many existing boilers without major modifications.

The disclosed burner creates outer fuel-lean patterns which create a proper ignition point, stabilize the resulting flame, and control the formation of NOx. The improved burner further creates inner fuel-rich patterns which are somewhat confined or controlled by the outer fuel lean patterns. A stage-type combustion thereby occurs, creating the ability to control the peak flame temperature, the rate of combustion, and the formation of NOx.

When the fuel quality and conditions change, a burner tip can be adjusted to various positions to change the fuel-lean and fuel-rich flame pattern to maintain optimum NOx levels and combustion performance. In the illustrated embodiment, the burner tip can be manually adjusted from outside the combustion zone.

In its broader aspects then, a burner embodying the present invention for use with a pulverized coal furnace comprises an annular passage having an inlet for receiving a pulverized coal and air, and an outlet for discharging the mixture for ignition. A plurality of blade-like members are spaced radially at the outlet. The members are shaped and arranged to form the fuel-rich zones and fuel-lean zones as the mixture is discharged at the outlet.

In the preferred and illustrated embodiment, the plurality of blade-like members comprises a set of main blades and a set of secondary blades disposed in alternating relationship with the main blades. Both main and secondary blades are skewed at an angle with respect to the longitudinal axis of the burner to thereby impart a rotational moment to the fuel streams. In the disclosed embodiment, the main blades are planar in shape and are disposed at an angle that is less than the angle at which the secondary blades are skewed. In the illustrated embodiment, the main blades are skewed at an angle of substantially 15°.

The secondary blades are skewed at a greater angle which, in the illustrated embodiment, is substantially 25°. In addition, in the preferred embodiment, the secondary blades are twisted and have an uniformly varying surface extending between a leading edge and a trailing edge which is non-planar. With the disclosed construction, converging fuel-rich channels are defined between a main blade and one adjacent secondary blade and diverging, fuel-lean channels are formed with the main blade and its other adjacent secondary blade.

At least a portion of the burner that includes the burner tip is mounted for sliding movement towards and away from a combustion zone. Adjustments, which in the illustrated embodiment comprise control rods, extend outside the combustion zone and are capable of manipulation by the operator to adjust the position of the burner tip relative to the outlet to adjust combustion rate, flame pattern, etc.

In an alternate arrangement, the burner tip is removably mounted to a tapered section of a core member. The tapered section includes a plurality of radial ribs onto which the burner tip is slid. The alternate burner tip is maintained in position by an annular stop and a plurality of keys that are welded to outlet ends of the radial ribs. Ramp surfaces forming part of the fuel lean channels are defined by removable ramp locks. The primary and secondary blades each include ridges which mate with complementally formed recesses in each ramp block. The ramp blocks are preferably held in position by lugs forming part of the retaining keys.

Each ramp block includes a bore adapted to receive the lug of a key. In the alternate embodiment, the primary and secondary blades extend outwardly from a hub portion which has a substantially uniform thickness. With this construction, thermally induced expansion and contraction in the burner tip does not produce excessive stress risers in the hub portion of the burner tip. Cooling slots are also provided in the core member section that supports the burner tip by which air is diverted to the hub portion of the burner tip to provide cooling.

The above and other features of the invention will be better understood from the detailed description that follows, when considered in connection with the accompanying drawings.

BEST MODE FOR CARRYING OUT THE INVENTION

Figure 1:
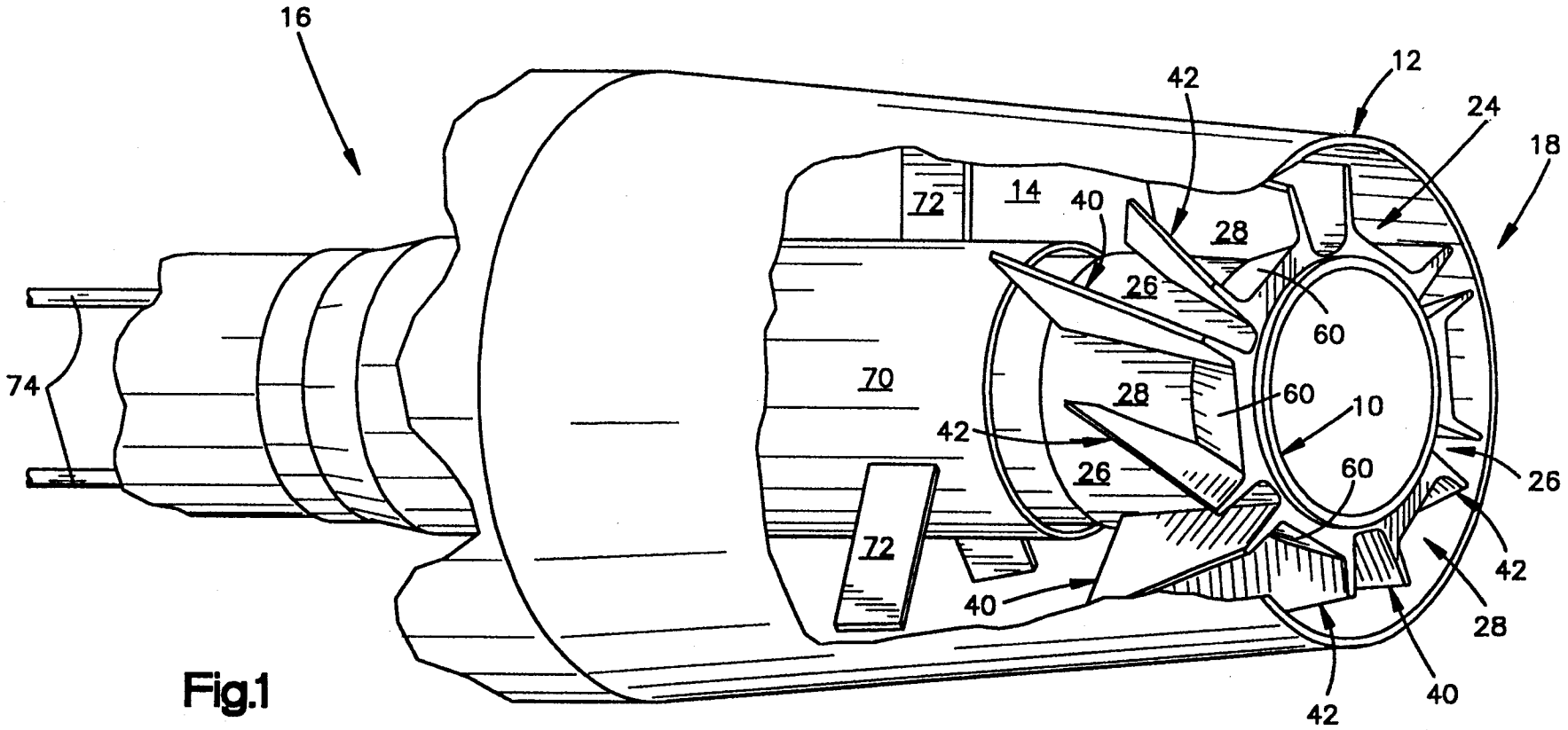
FIG. 1 is a perspective view of a burner constructed in accordance with a preferred embodiment of the invention with portions removed to show interior detail.

FIG. 1 illustrates the overall construction of a burner assembly constructed in accordance with the preferred embodiment of the invention and which is especially adapted for burning pulverized coal. The assembly includes a cylindrical core member 10, preferably centered with respect to an outer cylindrical housing member 12. An annular passage indicated generally by the reference character 14 is defined between the members 10, 12 and forms a flow path for a pulverized coal stream extending between an inlet indicated generally by the reference character 16 and an outlet 18. In operation, the outlet 18 opens into a combustion chamber forming part of the boiler. In large industrial boilers, a multiple number of burners may extend through a boiler wall (not shown) and extend into communication with the combustion chamber. As is known, as the pulverized coal stream exits the outlet 18, ignition occurs and the pulverized coal is burned in order to produce heat in the boiler.

In accordance with the invention, a stream dividing burner tip indicated generally by the reference character 24, is located near the outlet 18 and divides the pulverized coal stream into a plurality of alternating fuel-rich and fuel-lean fuel streams. In the preferred and illustrated embodiment, the burner tip 24 defines a plurality of channels 26, 28 positioned around the core member 10. During burner operation, the channels 26, 28 create the fuel rich and fuel lean streams, respectively. The channels 26, 28 are skewed with respect to the overall direction of flow in the annular passage 14 thereby imparting a rotational moment to the streams as they exit the nozzle.

Figure 3:
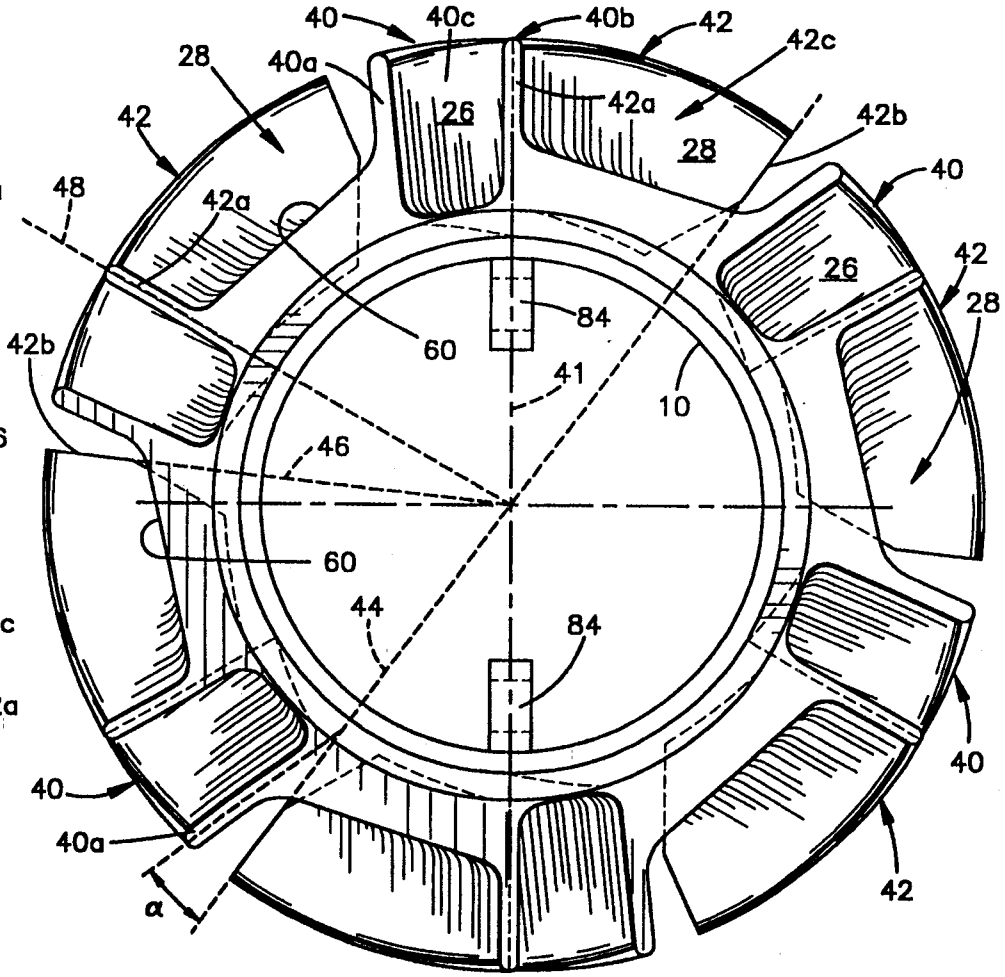
FIG. 3 is an end view of the nozzle shown in FIG. 3.
Figure 2:
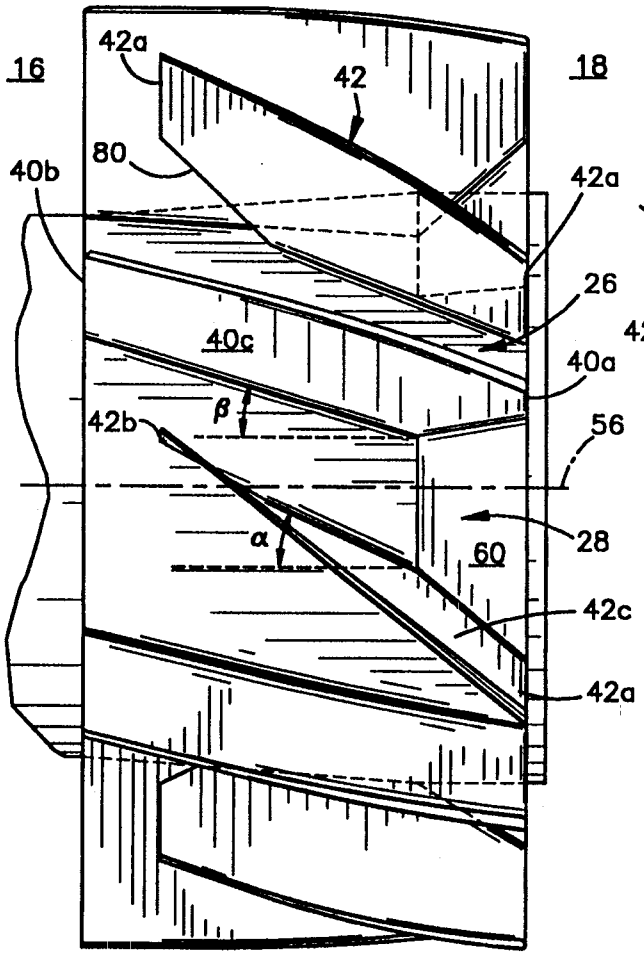
FIG. 2 is a fragmentary side view of a burner nozzle forming part of the burner show in FIG. 1.

In the illustrated embodiment, the channels 26, 28 are defined by individual main and secondary blade members 40, 42 which extend radially outwardly from the core member 10. Referring also to FIGS. 2 and 3, the main blade 40, in the preferred embodiment, includes a leading edge **40*b* (the edge nearest the inlet 16 to the nozzle) aligned with a radial vector 41 extending through a center line 56 of the core member 10. A trailing edge 40*a* (the edge nearest the outlet 16) is tilted at a predetermined angle $\alpha$ with respect to a radial vector 44. The main blade is skewed at an angle $\beta$ with respect to an imaginary reference plane aligned with the longitudinal axis of the core member as viewed in plan (shown best in FIG. 2). In the illustrated embodiment, the angle $\alpha$ and the angle $\beta$ are 20° and 15°, respectively and as a result, a relatively planar section 40*c* extends between the leading and trailing edges 40*a*, 40*b* of the main blade 40**.

In the preferred embodiment, the secondary blade 42 is twisted as compared to the substantially planar main blade 40. In particular, the secondary blade 42 includes a leading edge **42*b* aligned with a radial vector 46 and a trailing edge 42*a* aligned with another radial vector 48. The overall secondary blade is skewed at an angle $\delta$ with respect to an imaginary reference plane aligned with the longitudinal axis 56 of the core member 10 as viewed in plan (shown best in FIG. 2). In the preferred embodiment, the angle $\delta$ is substantially 25°. As a result, a twisted or curved surface 42*c*, preferably uniformally varying extends between the leading and trailing edges 42*a*, 42*b* of the secondary blade 42**.

In order to define converging and diverging channel cross-sections, the blades 40, 42 are positioned at two different angles with respect to the overall directional flow along the annular passage. The primary blade 40 is positioned at a first angle $\beta$ which in the illustrated embodiment is approximately 15° whereas the secondary blade is positioned at a greater angle $\delta$, which in the illustrated embodiment is approximately 25°. As a result, the channel 26 has a converging cross-section as defined between the blade 40 and one of its adjacent blades 42 whereas the channel 28 has diverging cross-section as defined between the blade 40 and the other of its adjacent blades 42.

In the preferred and illustrated embodiment, the diverging cross-section channel 28 creates a fuel lean stream. As seen best in FIG. 1, ramp-like surfaces 60 are defined in the fuel lean channels 28 near the outlet. These ramp-like surfaces 60 urge the fuel lean streams outwardly with respect to the center line 56 of the core member 10 as the streams are discharged from the tip. As seen in FIG. 1, similar ramp-type surfaces are not defined by the fuel rich channels 26 and as a result, these streams although including a rotational component are not urged outwardly with respect to the center line 56. As a result, a fuel lean zone produced by the outwardly directed fuel lean streams surrounds a fuel rich combustion zone formed by the fuel rich streams, during operation of the burner. The combination of a peripheral fuel lean zone surrounding a fuel rich zone provides combustion in which the formation of $NO_x$ is reduced.

In addition, the channels 26 which converge in cross-section as the pulverized coal stream traverses from the inlet to the outlet ends of the channels, tend to increase the velocity of the stream. On the other hand, the diverging cross-section of the fuel lean channels 28 tend to reduce the speed of the fuel lean stream. As a result, the rotational force imparted to the fuel rich stream is greater than the rotational force imparted to the fuel lean stream.

As seen in FIG. 1, the burner is self-supported by a mounting member 70 which is positioned centrally within the outer housing 12 by a plurality of radial support struts 72. A pair of control rods 74 extend into the support member 70 and are attached to the burner tip 24. The control rods 74 enable an operator to change the position of the tip assembly with respect to the outer housing member 12. In particular, the tip 24 can be moved toward and away from the combustion zone and can be extended such that the outlet end of the tip 24 is exposed beyond the end of the outer housing member 12. Conversely, the tip 24 may be retracted so that it is totally enclosed by the outer housing member 12. Movements of the tip with respect to the combustion zone allow the flame and rate of combustion to be adjusted by the operator.

Figure 4:
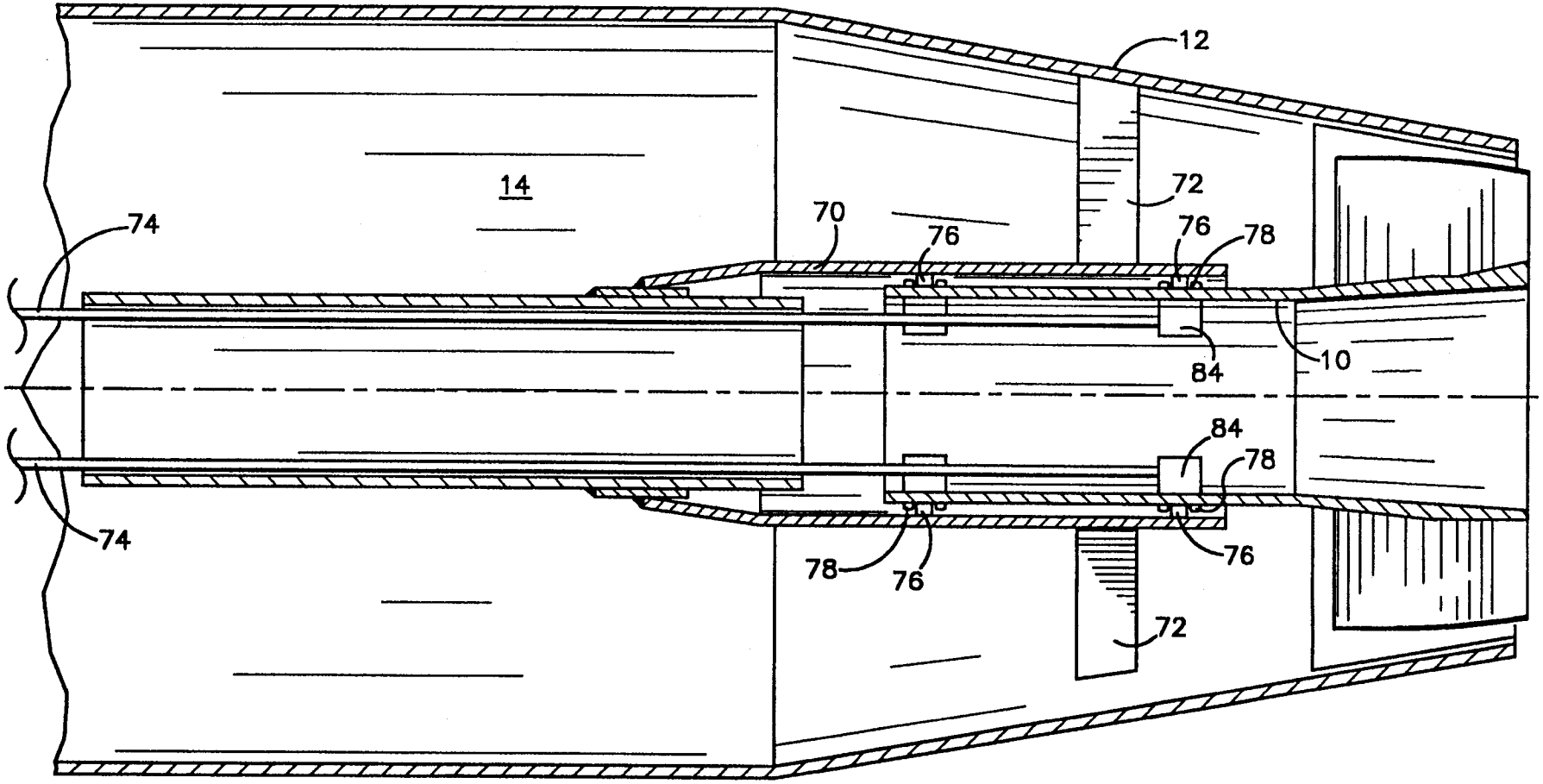
FIG. 4 is a sectional view, shown somewhat schematically, of the burner.

Referring also to FIG. 4, the core member 10 is mounted for sliding movement with respect to the mounting member 70. Slide support members 76 enable sliding movement between the two members. Packing 78 is used to provide a seal between the members 70 and 10 while still allowing sliding movement. The control rods 74 are attached to blocks 84 which, in turn, are welded to the inside of the core member 10. The control rods 74 extend to the outside of the burner region and are accessible by the boiler operator. Suitable manipulating devices such as turn buckles or threaded adjustment members (not shown) can be used to move the control rods 74 longitudinally to extend or retract the burner tip.

Referring to FIG. 2, the secondary blade 42 includes a relieved portion indicated generally by the reference character 80. In particular, the leading edge **42*b* of the blade 42 does not directly meet the inner housing member 10. A portion is removed indicated generally by the reference character 80**. The extent of the relieved portion is determined by the application and is used in order to provide fine adjustments to the fuel lean, fuel rich stream patterns.

Figure 5:
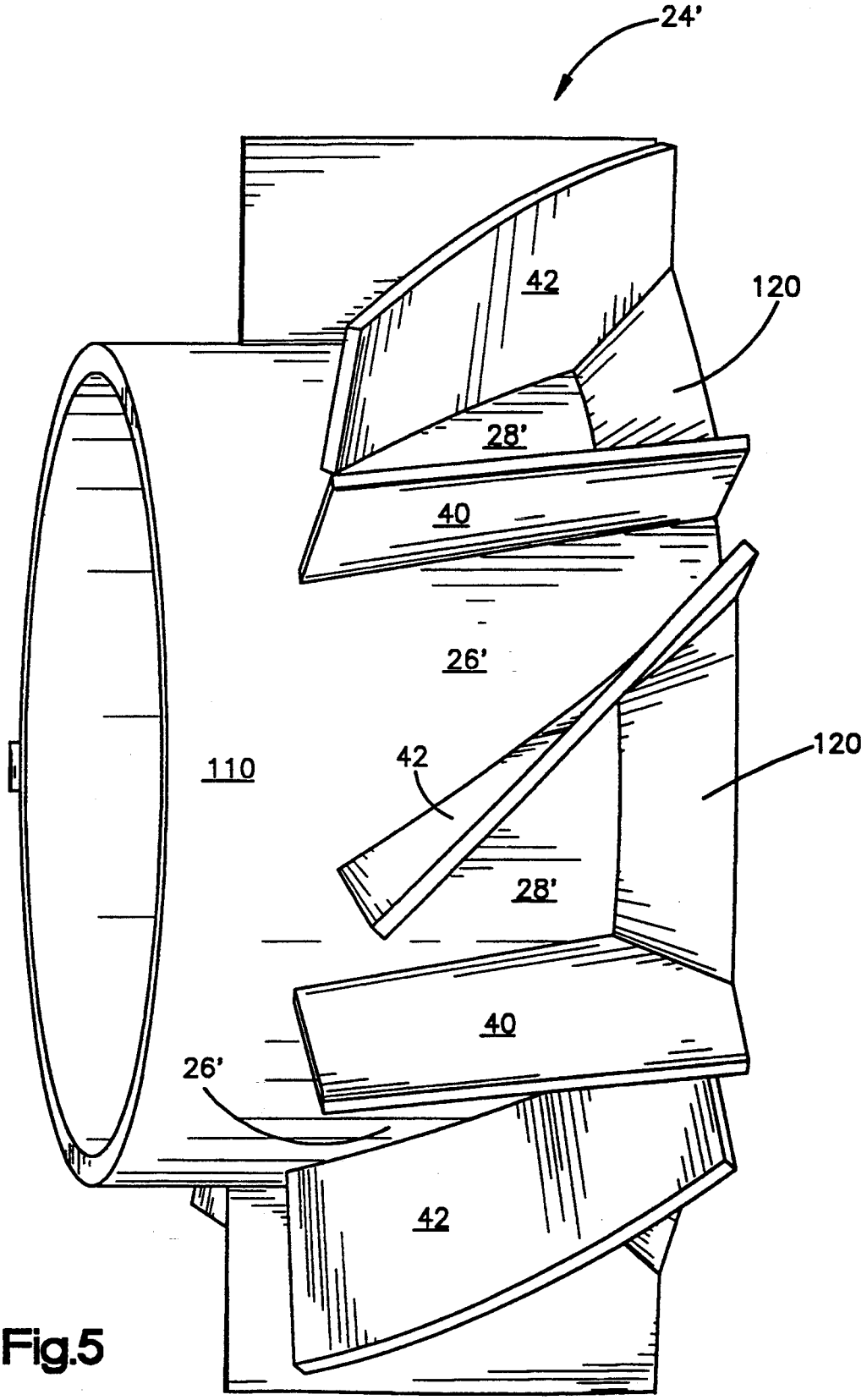
FIG. 5 is a perspective view of an alternate embodiment of a stream dividing burner tip, constructed in accordance with the preferred embodiment of the invention.
Figure 6:
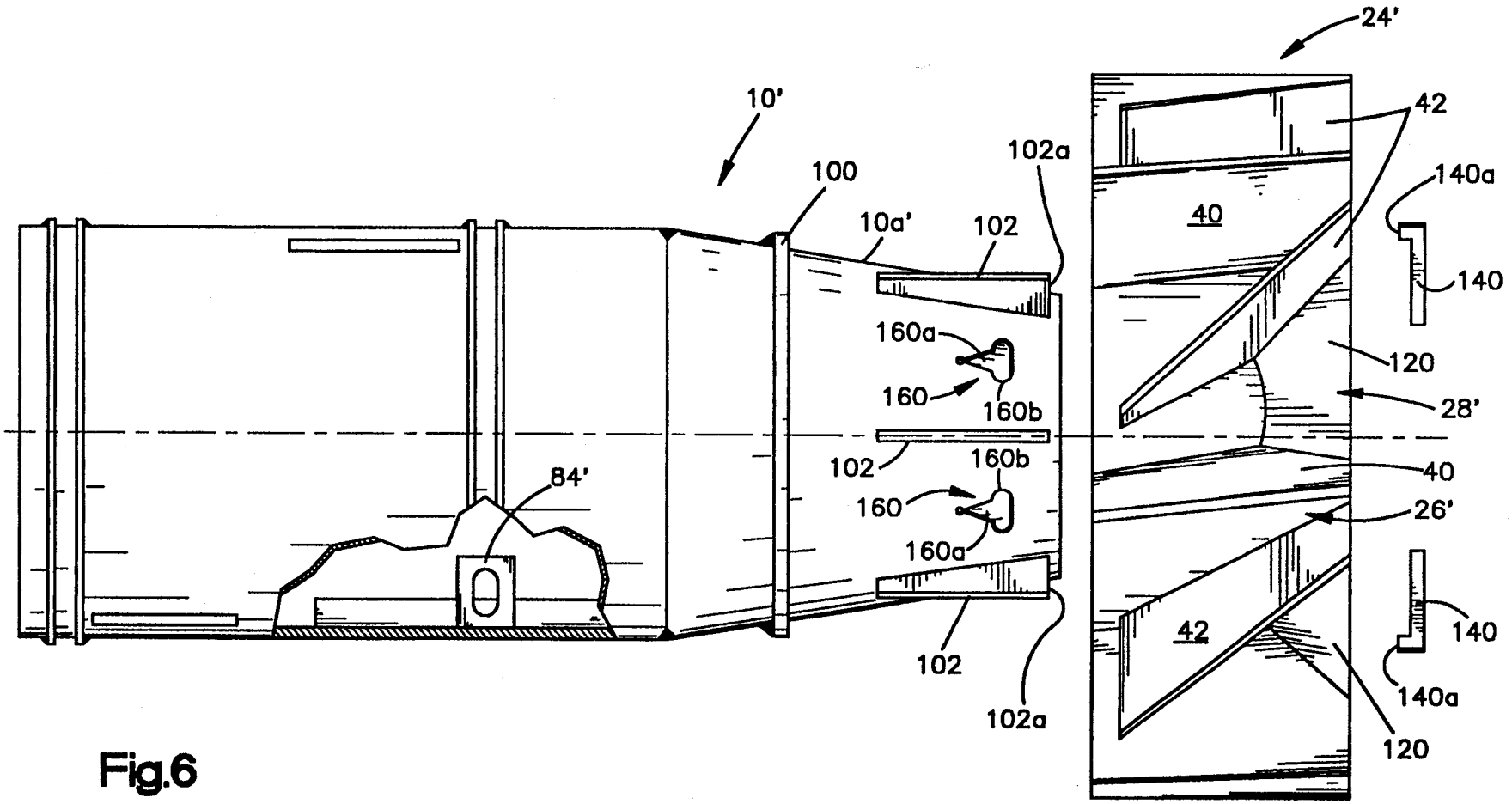
FIG. 6 is an exploded view of a portion of a burner constructed in accordance with another preferred embodiment of the invention.
Figure 7:
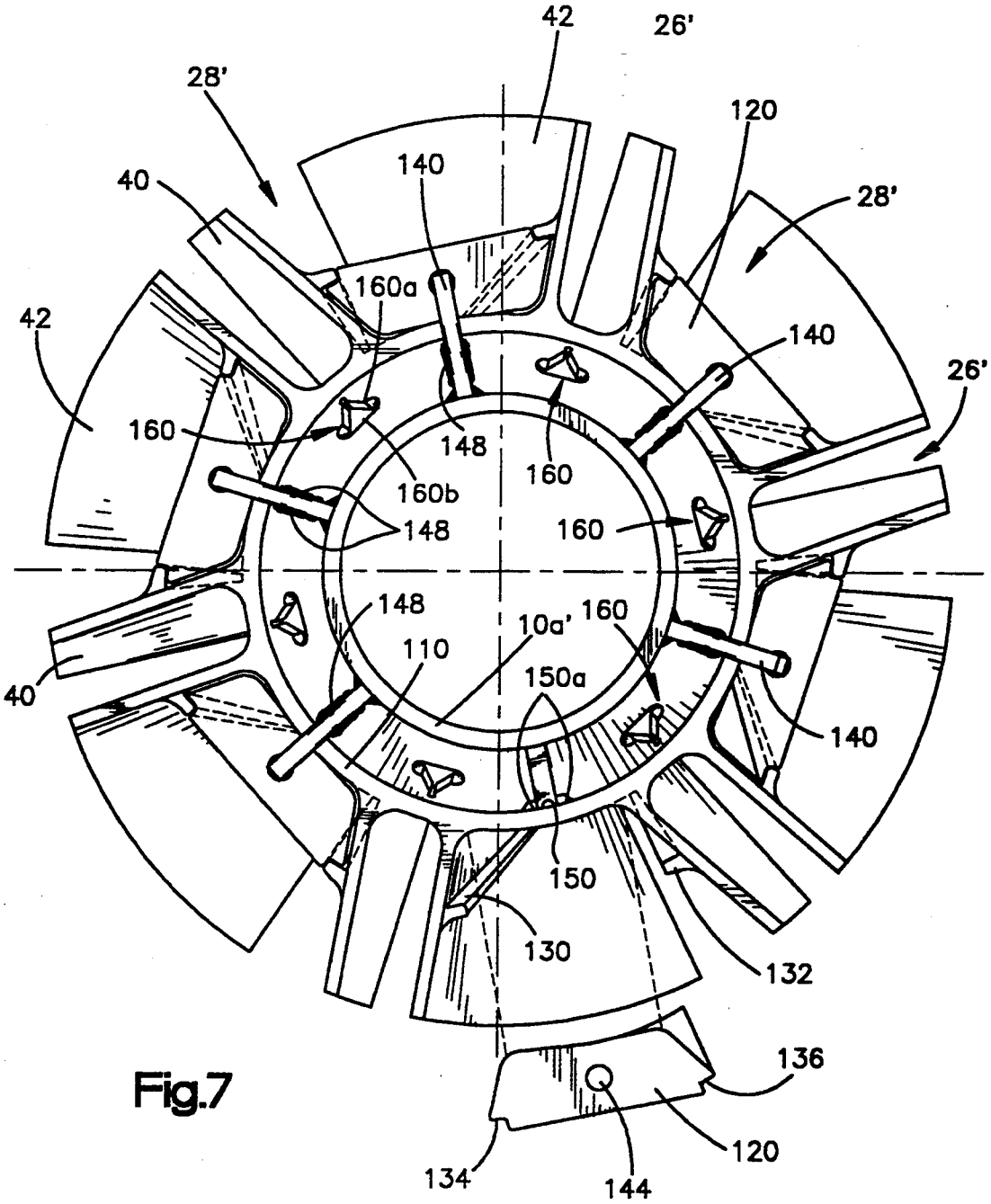
FIG. 7 is an end view of the burner tip as shown in FIG. 5.

Turning now to FIGS. 5–7, an alternate embodiment of the burner tip is illustrated. In this embodiment, a stream dividing burner tip 24' is removably supported on a core member 10'. The core member 10' corresponds to the core member 10, shown in FIG. 4, and is slidably supported within a mounting member 70 (also shown in FIG. 4). The core member 10' also includes lugs 84' to which control rods 74 (shown in FIG. 4), are connected by which the core member 10' is moved axially in order to adjust the position of the burner as explained above. An outlet end **10*a'* of the core member 10*a'* tapers inwardly. An annular stop 100 is welded along the tapered portion 10*a'* and determines the innermost position of the stream dividing assembly 24'. A plurality of support ribs 102 are welded to the core member portion 10*a'* and serve as a support, as will be explained, for the burner tip 24'**.

Referring also to FIGS. 3, the alternate stream dividing burner tip 24' also includes primary and secondary blades 40', 42', respectively. These blades are skewed at the same or similar angles as the blades 40, 42 shown in FIGS. 1–4. Similar fuel rich, fuel lean channels 26', 28' are defined between adjacent blades.

The stream dividing burner tip 24' includes a hub-like section 110 from which the blades extend. The hub-like section is of relatively uniform thickness, as seen best in FIGS. 1 and 3. In this alternate embodiment, ramp surfaces 60' are defined by replaceable ramp blocks 120. In the embodiment in FIGS. 1–4, ramp surfaces 60 an integrally cast into the assembly. As seen best in FIG. 7, the primary and secondary blades 40', 42' include respective ramp ridges or guides 130, 132 which mate with corresponding recesses 134, 136 formed in each ramp block 120.

The ramp block 120, as well as the stream dividing tip 24' are held in position by a plurality of locking keys 140. Referring to both FIGS. 5 and 6, the stream dividing tip 24' is slid onto the ribs 102 welded to the core member 10'. In the preferred embodiment, the tip 24' is pushed leftwardly (as viewed in FIG. 2) onto the core member 10' until the tip 24' abuts the annular stop 100. The keys 140 which include a short transverse lug **140*a'* are then welded to outer ends 102*a* (See FIG. 6) of the support ribs 102. As seen in FIG. 7, the lug portion 140*a* of the key 140 is inserted into an aperture 144 formed in each ramp block 120, thereby holding the ramp block in position. A lower end of each key 140 is then welded to an associated support rib 102. The welding locations are indicated by the reference character 148 in FIG. 7. In the preferred embodiment, the burner tip 24' is not welded to the keys 140 or to the support ribs 102. A slight axial clearance is provided so that movement due to thermal expansion can be accommodated in the tip 24', with respect to the core 10'. As seen best in FIG. 7, a channel 150 defined by a pair of raised lugs 150*a* formed on the inside of the hub portion 110 receive one of the support ribs 102. The coupling achieved between the lugs 150*a* and the rib 102 prevent relative rotation of the assembly 24', with respect to the core member 10'**, while allowing relative axial movement between two components.

As seen best in FIG. 6, cooling ports 160 are provided in the core member 10' and allow a small amount of combustion air to be diverted to the region between the core member 10' and the underside of the hub portion 110 of the tip 24', to provide cooling The openings 160 are defined by a triangular portion **160*a* and a transverse slotted portion 160*b*. It should be apparent because the ports are located in the tapered portion 10*a'* of the core member 10, air within the core member 10' will tend to flow straight ahead. By having the transverse, slotted region 160*b* downstream of the triangular portion 160*a***, and located at a diameter that is less than the diameter at which the triangular portions are formed, a sufficient flow of air out of the ports can be achieved.

The burner of the alternate construction can be easily serviced. The stream dividing tip 24' can be replaced by simply removing the keys 140 and then sliding the assembly 24' off the core member 10'. In addition, the individual ramp blocks 120 can be replaced, should that become necessary, or can be reused on a replacement burner tip 24'.

By slidably supporting the assembly 24' on the end of the core assembly 10', thermal expansion in the assembly can be accommodated since it is not rigidly attached or welded to the core member. By making the ramp surfaces part of a separate component, the hub portion 110 of the stream dividing burner tip 24' can be of a uniform thickness. With a uniform thickness, thermally induced expansion and contraction in the hub portion is substantially uniform, thereby reducing thermally induced stress levels or stress risers in the burner tip 24'.

Although the invention has been described with a certain degree of particularity, it should be understood that those skilled in the art may make various changes to it without departing from the spirit or scope of the invention as hereinafter claimed.

I claim:

1. A burner nozzle for combusting pulverized coal, comprising:

a) structure defining an annular passage extending from a source of pulverized coal carried by an air stream to an outlet, said outlet communicating with a combustion region for said pulverized coal;

b) said annular passage defined between an inner cylindrical member and an outer housing member, surrounding said inner cylindrical member;

c) a fuel stream dividing unit, near said outlet, for dividing said pulverized coal stream into fuel rich and fuel lean streams, including:

i) a plurality of first blade members, generally radially directed, and circumferentially spaced about a hub-like portion of said unit;

ii) second blade members spaced circumferentially about an inner cylindrical member and in an alternating relationship with said first blade members;

iii) said first blade members defining a first angle with respect to an imaginary plane extending through a center line of said inner cylindrical member;

iv) said second blade members defining a second angle with respect to an imaginary reference plane extending through said centerline that is greater than said first blade angle, such that a channel diverging in cross-section is defined between a first blade member and an adjacent second blade member and a channel converging in cross-section is defined between said second blade member and a next adjacent first blade member;

v) ramp blocks defining ramp-like surfaces, removably mounted at outlet ends of said diverging cross-section channels.

2. The apparatus of claim 1 wherein said hub-like portion of said unit has at least a segment having a substantially uniform thickness.

3. The apparatus of claim 1 wherein said inner cylindrical member includes a section configured to removably receive said fuel stream dividing unit.

4. The apparatus of claim 3 further comprising anti-rotation structure for inhibiting relative rotation between said fuel stream dividing unit and said inner cylindrical member.

5. The apparatus of claim 4 wherein said anti-rotation structure comprises lug members forming part of said unit engageable with a support rib forming part of said inner cylindrical member.

6. The apparatus of claim 5, wherein said unit is maintained in position between a stop formed on said inner cylindrical member and a plurality of key members that are secured at least in part to support structure defined by said inner cylindrical member.

7. The apparatus of claim 6 wherein said key members concurrently maintain the operative positions of said ramp blocks.

8. The apparatus of claim 7 wherein said key members are welded to said ramp blocks and welded to support ribs forming part of said inner cylindrical member.

9. The apparatus of claim 1 wherein adjacent blades that define diverging cross-section channels include guides engageable with recesses formed on said ramp blocks.

10. A burner nozzle for burning an annular stream of pulverized coal, comprising:

a) an annular passage defined between an outer housing member and an inner housing member extending between an inlet end and an outlet;

b) a coal stream dividing unit located near said outlet end and disposed in said fuel stream path to divide said pulverized said coal stream into fuel rich and fuel lean streams;

c) said assembly including members defining a plurality of channels having an expanding cross-section; and, d) a plurality of channels interposed between said expanding channels, having a converging cross-section such that an outlet side of said channel has a smaller cross-section than an inlet side of said channel;

e) said inner housing member including a support section including support ribs for removably receiving said stream dividing unit and cooling ports for directing combustion air to a region defined between an outside surface of said support section and an inside surface of said stream dividing unit.

11. The apparatus of claim 10 wherein said support section is tapered in cross-section and includes an annular stop for determining an inner most position for said unit and further includes retaining members for retaining said unit on said section while allowing slight relative axial movement between said unit and said support section.

12. The apparatus of claim 11 further comprising ramp blocks in said expanding cross-section channels including recesses for receiving members formed on certain of said blade members, said ramp blocks being maintained in position by said retaining members.

13. The apparatus of claim 10, wherein said expanding cross-section channels include a ramp blocks defining ramp-like surfaces near an outlet side of said channels which direct said stream in a direction diverging from a center line of said inner housing member.

14. The apparatus of claim 12 wherein said ramp blocks include apertures for receiving a lug forming port of said lug member.

15. A burner tip for a burner used to combust a pulverized coal stream, comprising:

a) an inner support member defining a hub-like member having a substantially uniform wall thickness;

b) fuel stream dividing structure including:

i) a plurality of first blade members, generally radially directed, and circumferentially spaced about said inner support member;

ii) second blade members spaced circumferentially about said inner support member and in an alternating relationship with said first blade members;

iii) said first blade members defining a first angle with respect to an imaginary plane extending through a center line of said inner support member;

iv) said second blade members defining a second angle with respect to an imaginary reference plane extending through said centerline that is greater than said first blade angle, such that a channel diverging in cross-section is defined between a first blade member and an adjacent second blade member and a channel converging in cross-section is defined between said second blade member and a next adjacent first blade member; and, c) ramp blocks defining ramp-like surfaces, disposed near outlet ends of said diverging cross-section channels.

16. The burner tip of claim 15, wherein said first blade angle is substantially 15° and said second blade angle is substantially 25°.

17. The burner tip of claim 15 wherein said inner support member is cylindrical and includes a tapered portion for receiving said fuel stream dividing structure.

18. The burner tip of claim 17 wherein said tapered portion of said inner support member includes a plurality of circumferentially spaced axially directed support ribs for supporting said stream dividing structure in coaxial alignment with an axis of said inner support member.

19. The burner tip of claim 18 wherein said fuel stream dividing structure includes lug members engageable with at least one of said support ribs said engagement between said lug members and said support rib inhibiting relative rotation between said fuel stream dividing structure and said inner support member.

20. The apparatus of claim 18 wherein said tapered portion defines cooling ports for directing at least some combustion air traveling through said inner support member through a region defined between an outside of said tapered portion and an inside surface of said fuel stream dividing structure.

21. The burner tip of claim 20 wherein said cooling ports include a triangular portion and a transverse slot portion.

22. A burner tip for a burner used to burn a stream of pulverized coal, comprising:

a) a cylindrical support member having an inlet end and an outlet end when said tip is placed in an operative position within said burner;

b) a coal stream dividing assembly located at or near said outlet end of said support member, said assembly operative to divide a pulverized coal stream into fuel rich and fuel lean streams;

c) said assembly including members defining a plurality of channels having an expanding cross-section; and, d) a plurality of channels interposed between said expanding channels, having a converging cross-section such that an outlet side of said channel has a smaller cross-section than an inlet side of said channel;

e) an inner support member having an end configured to removably receive said coal stream dividing assembly.

23. The burner tip of claim 22, wherein at least some of said expanding cross-section channels are defined at least in part by ramp blocks having ramp-like surfaces near an outlet side of said channels which direct said stream in a direction diverging from a center line of said support member.

24. The burner tip of claim 22, wherein said converging channel is defined in part by a first wall disposed at a first predetermined angle with respect to a center line of said support member and a second wall spaced from said first wall and positioned at a second angle greater than said first angle.

25. The burner tip of claim 22 wherein said end of said inner support member is tapered and includes support means for maintaining a predetermined alignment of said coal stream dividing assembly with respect to an axis of said inner support member when said fuel stream dividing assembly is in an operative position.

26. The burner tip of claim 24, wherein said second wall is tilted at a predetermined angle with respect to a radial line passing through said center line of said support member.

27. The apparatus of claim 25 further comprising key members for maintaining the operative positions of said ramp blocks and said fuel stream dividing assembly on said inner support member.

28. The apparatus of claim 25 wherein said key members are secured to said ramp members and to said support means.

* * * * *